US006837593B1

(12) United States Patent
Schütz et al.

(10) Patent No.: US 6,837,593 B1
(45) Date of Patent: Jan. 4, 2005

(54) REFLECTOR FOR A REFLECTOR LAMP, LAMP AND CANOPY FOR A LAMP

(75) Inventors: Ottokar Schütz, Schwenningen (DE); Werner Maurer, Schaffhausen (CH); Urs Schürmann, Schaffhausen (CH); Ralph Wichmann, Schaffhausen (CH)

(73) Assignee: Lighting Innovation Center AG, Schaffhausen ( * ) Notice: Subject to any disclaimer, the term of this patent is extended or adjusted under 35 U.S.C. 154(b) by 0 days.

(21) Appl. No.: 10/088,963

(22) PCT Filed: Sep. 21, 2000

(86) PCT No.: PCT/EP00/09263

§ 371 (c)(1),
(2), (4) Date: Jul. 8, 2002

(87) PCT Pub. No.: WO01/22000

PCT Pub. Date: Mar. 29, 2001

(30) Foreign Application Priority Data

Sep. 23, 1999 (DE) ..... 199 45 692
May 8, 2000 (DE) ..... 100 22 257

(51) Int. Cl.[7] ..... F21V 29/00
(52) U.S. Cl. ..... 362/218; 362/298; 362/307

(58) Field of Search ..... 362/218, 260, 362/294, 298, 297, 346, 373, 147, 307, 404

(56) References Cited

U.S. PATENT DOCUMENTS

| | | | | |
|---|---|---|---|---|
| 2,338,077 A | * | 12/1943 | Scribner | 362/218 |
| 4,045,665 A | | 8/1977 | Williams et al. | |
| 4,503,360 A | * | 3/1985 | Bedel | 362/373 |
| 4,729,075 A | | 3/1988 | Brass | |

FOREIGN PATENT DOCUMENTS

| | | |
|---|---|---|
| DE | 6909910 | 3/1969 |
| DE | 3318264 | 11/1984 |
| DE | 8911576 | 1/1990 |
| DE | 19754931 | 3/1999 |
| EP | 0442246 | 8/1991 |
| FR | 2267518 | 11/1975 |
| GB | 2215447 | 9/1989 |

* cited by examiner

*Primary Examiner*—Y My Quach Lee
(74) *Attorney, Agent, or Firm*—Hedman & Costigan, P.C.

(57) ABSTRACT

A reflector (8, 9) for a lamp (24), including at least one reflective surface (12), the reflector being designed such that the light which is emitted by a luminous element (1) of the lamp (24) and reflected at the reflective surface (12) does not impinge on the luminous element (1).

11 Claims, 13 Drawing Sheets

REFLECTOR FOR A REFLECTOR LAMP, LAMP AND CANOPY FOR A LAMP

FIELD OF THE INVENTION

The present invention relates to a lamp featuring a holding device for a luminous element as well as a housing which, at least partially, surrounds an interior space, the housing having an upper housing part and a lower housing part.

BACKGROUND OF THE INVENTION

Well-known are devices which use a closed lamp system. In this connection, a heavy increase of the interior space temperature of the lamp takes place, resulting in a reduction in efficiency of the lamp. The light emanating from the lamp is guided in the desired direction, a wide distance being required between the luminous element and the reflector, resulting in an increased overall height of the indirect lamp. The known reflectors featuring parabolically shaped reflector segments produce a narrow-angle light distribution but no wide-angle light distribution which is free of direct glare. This narrow-angle light distribution gives rise, for example, to an increased reflection formation on a tabletop.

It is an object of the present invention to provide a lamp with which a higher efficiency is attained.

SUMMARY OF THE INVENTION

This objective is achieved by a lamp featuring a holding device for a luminous element as well as a housing which, at least partially, surrounds an interior space, the housing having an upper housing part and a lower housing part, at least one gap existing between the upper housing part and the lower housing part through which air exchange is possible between the interior space of the lamp surrounded by the housing and the external space.

Because of the air exchange between the interior space and the external space through the gap, the inside temperature will increase due to thermal heating only slightly in a region of the lamp whereby a considerably higher efficiency of the luminous element is attained compared to the known closed lamps in whose interior there exists an overtemperature of up to 30° C. which corresponds to a reduction in efficiency of about 30% at normal room temperature. In particular when using a fluorescent lamp because of the thermal heating in a region, the light output ratio strongly depends on the ambient temperature, that is the interior space temperature of the lamp. Using a lamp according to the present invention, it is possible for the reduction in efficiency of a fluorescent lamp to lie in a range below 5%.

In an advantageous embodiment of the just described lamp according to the present invention, provision is made for the upper housing part to feature a first transmitter/reflector and/or for the lower housing part to feature a second reflector which is designed according to one of the embodiments described above. In this manner, the efficiency is further increased since, besides the reduction of the ambient temperature of the fluorescent tube through the gap, a further increase in efficiency is attained with regard to the emitted light since no light reflected by the reflector is reflected into the luminous element again.

In a further advantageous refinement of the present invention, provision is made for the housing to have a cylindrical or tubular shape. A housing formed in such a manner is particularly easy and inexpensive to manufacture and suitable for receiving a tubular commercial fluorescent tube.

In another expedient embodiment of the present invention, provision is made for the upper housing part to be connected to the lower housing part via connecting means, the upper housing part and/or the lower housing part being preferably connected to the connecting means in an easily detachable manner. In this manner, the specific part can be replaced very easily, for example, when it is defective or when the user of the lamp wants to use a different part which appears to him to be better suited because of aesthetic, illumination or other reasons.

In a further advantageous refinement of the present invention, provision is made for the connecting means to be arranged at the ends of the housing. In this manner, the largest possible space is made available for an illuminant which is arrangeable in the lamp.

Moreover, the connecting means can engage best with the housing at the end thereof, and can also be accessed best there, thus enabling easy replacement.

In a further expedient embodiment of the present invention, provision is made for the connecting means to have noses which engage with the upper housing part and/or with the lower housing part, forming a positive lock. In this manner, a simple but secure connection between the upper housing part or the lower housing part and the connecting means is guaranteed.

In another expedient refinement of the present invention, provision is made for the lower housing part to have a two-part design featuring a carrier body to which the reflector is detachably connected and which is held in its position relative to the upper housing part by the connecting means. This allows easy replacement of the reflector without having to detach the whole lower housing part from the connecting means. Because of this, first of all, time is saved when replacing a reflector or the lamp and, secondly, material and thus cost are saved as well.

In a further advantageous embodiment of the present invention, provision is made for the carrier body to have a tubular design. It is designed, for instance, as circular tube, rectangular tube, or oval tube, the cross-sectional area of the tube being shaped, in particular, as a curve (closed line) of second order. A tubular carrier body is very easy and inexpensive to manufacture and can moreover be easily connected to the connecting means.

In a further advantageous refinement of the present invention, provision is made for the carrier body to have a circular design. In this manner, it is also possible to provide a lamp for a fluorescent lamp having a circular shape. Because of this, the advantages described above can be optimally used in the case of circular luminous element as well.

In another advantageous embodiment of the present invention, provision is made for the housing to be formed in one piece. A housing of that kind is easy to manufacture, and there is no risk for the lower housing part or the upper housing part to unintentionally detach from the connecting means, for example, because they where not properly connected thereto. In this manner, the lamp is prevented from damage.

In a further advantageous refinement of the present invention, provision is made for the at least one gap to run horizontally. This is particularly advantageous in lamps which extend in a horizontal plane because the gap can then be made especially long, thus resulting in a particularly good air exchange between the interior space and the external space of the lamp.

In a further expedient refinement of the present invention, provision is made for the at least one gap to be sized such that at least one of the reflectors fits through it. In this manner, it is very easy to replace a reflector by simply pulling it out through the gap of the lamp and pushing a new reflector through the gap into the lamp.

In another expedient embodiment of the present invention, provision is made for two gaps which are parallel to each other. In this manner, the air exchange between the interior space of the lamp and the external space is further improved so that the efficiency of the fluorescent lamp (inside the lamp) is further increased. It is preferred for the two gaps to be arranged on two opposing sides of the lamp. Because of this, an advantageous aesthetic effect is achieved since the lamp has a symmetric design.

In a further advantageous embodiment of the present invention, provision is made for the upper housing part to have a convex design with respect to the interior space of the housing. In this manner, a roof is formed which covers the luminous element and which prevents dirt which falls down from above from falling into the lamp. The dirt which falls down onto the upper housing part slides down outwardly along the curvature of the upper housing part toward the edge and finally falls off. Dirt which does not fall off, such as dust, can be easily cleaned off because of the convex shape of the upper housing part since there are no edges or corners which are difficult to access.

In another advantageous refinement of the present invention, provision is made for the upper housing part to be transparent. Because of this, the entire light which is emitted and reflected upward reaches the ceiling from where it is reflected into the room as stray light producing a very pleasant sensation. Thus, a very high efficiency is achieved for this indirect light.

In another expedient refinement of the present invention, provision is made for a suspended lamp which is connectable to a ceiling using at least one fastening element. It is preferred for the at least one fastening element to be a sheathed electric cable. Because of this, it is not required but possible to use a steel cable as a holder at which the lamp is suspended from the ceiling. Therefore, a lamp of that kind can be installed in a particularly simple manner. This is achieved in that a lamp which is produced according to one of the embodiments described above can have a very light design.

In a further expedient embodiment of the present invention, provision is made for the at least one fastening element to be covered by a covering having a concave shape with respect to the lamp, in particular, having the shape of a circular segment in a cross section. A canopy-like covering of that kind has the advantage that the light emitted or reflected upward does not have any punctiform high luminances at the ceiling but that a homogenous illuminance pattern is attained at the ceiling because of the canopy-like covering. This results in a pleasant illumination by the indirect light which is scattered by the canopy-like covering.

In a further advantageous refinement of the present invention, provision is made for the lamp to be able to swivel about an axis parallel to the at least one gap. In this manner, it is possible to turn the lamp into such a position that the at least one gap is situated such that is constitutes the lowest point of the lamp. As a result, foreign bodies which possibly have entered the interior space of the lamp fall out as, for example, flies which were attracted by the luminous element and which do not withstand the thermal stress due to the high temperature at the lamp surface inside the lamp. Therefore, it is not necessary to take the lamp apart to get out such foreign bodies therefrom.

In a further expedient refinement of the present invention, provision is made for a luminous element to be arranged in the holding device of the lamp. It is preferred for the luminous element to be a fluorescent lamp, in particular, a high-intensity fluorescent lamp. In the case of a relatively small tube, a high luminance and thus good room illumination are attained in this manner in connection with which the above described advantages of the depicted embodiments show to advantage particularly well. In particular, a strong increase in efficiency is given compared to known lamps featuring fluorescent lamps. Also given are a homogenous illumination by the indirect light and a good glare suppression of the direct light. This glare suppression is necessary because modern fluorescent lamps have luminances of up to 30000 cd/m$^2$. When looking directly into such a lamp, the perception of the eye is switched off for a short time so that black spots are seen before the eye during a short time. This is avoided via the glare suppression measures. Moreover, the luminance of the lamp and of the surfaces surrounding it is reduced in such a manner that no excessive luminances occur in the visual field of the observer during work in front of a screen so that the observer does not perceive any glare.

Moreover, the objective is achieved by a method for cleaning the interior space of a lamp which is designed according to one of the embodiments described above, the lamp being turned about the parallel axis. The advantages attained by such a method are described above.

Furthermore, the objective is achieved by a method for illuminating a room, using a lamp which is designed according to one of the above described embodiments and/or a reflector which is designed according to one of the above described embodiments. The advantages attained by such a method are specified above in detail within the scope of the description of the reflector or of the lamp so that reference is made thereto at this point. In particular, the object is achieved by a method for illuminating a room in connection with which light is emitted by an illuminant, reflected by a reflector in the glare suppression region and falls around the illuminant into the room to be illuminated. Using this method, in particular the efficiency of the illumination of a room is increased because no light which penetrates into the glare suppression region is reflected back into the illuminant but, being guided around the illuminant, rather is able to fall into the room to be illuminated.

Moreover, the object is achieved by a method for reducing the luminance in the direct light of a lamp in connection with which a partially transparent reflector which is designed according to one of the embodiments described above is brought into the radiation field, in particular into the cone of radiation of the luminous element. Because of this, it is possible to look into the region from which light of the lamp is thrown out without being dazzled even in the case of luminous elements featuring a high luminance. However, the reduction of luminance in the direct light does not mean that thereby a smaller amount of light exists the lamp but the light which does not pass through the partially reflector is perceived as indirect light which is scattered, for example, via the ceiling. This gives rise to an optimum efficiency.

In a further embodiment of this method according to the present invention, provision is made for the degree of reduction in luminance to be varied by inserting different partially transparent or transparent reflectors. In this manner, it is possible to respond to the individual requirements of the room or to the personal preferences of the user of the lamp. Thus, it is possible, for instance, to reduce the luminance of the direct light to a greater degree if a lamp is concerned which frequently appears in the visual field of the user, for example, when looking at a screen, such as a lamp above a table. Equally, it is possible to chose a lower reduction in direct luminance if the lamp is installed at a location where it hardly lies in the visual field of the user as, for instance, behind a sofa, a cabinet or a partition wall.

In a further advantageous refinement of this method, provision is made for the attained glare-suppression angle to be variable by inserting and/or moving different partially transparent or transparent reflectors which are designed according to one of the embodiments described above. Thus, the glare-suppression angle at which the direct light undergoes glare suppression can be adapted to the specific conditions of the room or to the personal taste of the user through the selection of the reflector and/or the variation of the distance of the reflector from the illuminant. For instance, it is not necessary to provide a large glare-suppression angle for lamp which is situated in a corner or niche. However, this may indeed be desired in the case of a lamp which is located free in the room.

Furthermore, the object is achieved by using a partially transparent reflector which is designed according to one of the above described embodiments for glare suppression of the direct light of a lamp. With regard to the advantages, reference is made to the above explanations.

Moreover, the object is achieved by using a partially transparent reflector which is designed according to one of the above described embodiments and for guiding the light which is emitted by a luminous element of a lamp around the luminous element. With regard to the embodiment details of the partially transparent reflector and to the advantages resulting from its use, reference is made to the above explanations.

Furthermore, the object is achieved by using a lamp which is designed according to one of the embodiments described above for increasing the efficiency of the luminous element. With regard to the advantages and further details, reference is made to the above explanations. Further preferred embodiments of the present invention will be depicted in the drawings and explained in the figure description.

BRIEF DESCRIPTION OF THE INVENTION

Figure 1:
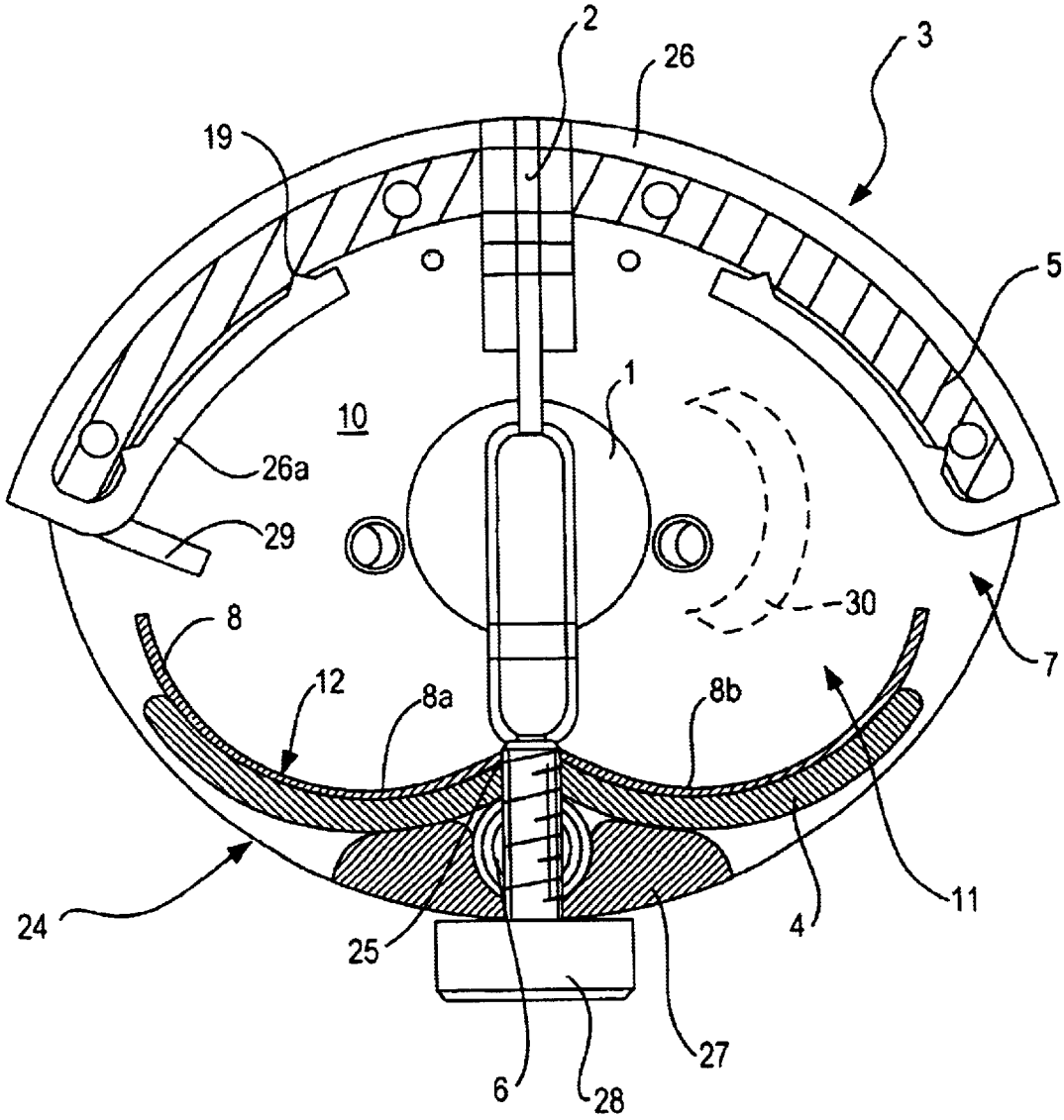
FIG. 1 is a section through a first exemplary embodiment of a lamp according to the present invention featuring a reflector according to the present invention.
Figure 2:
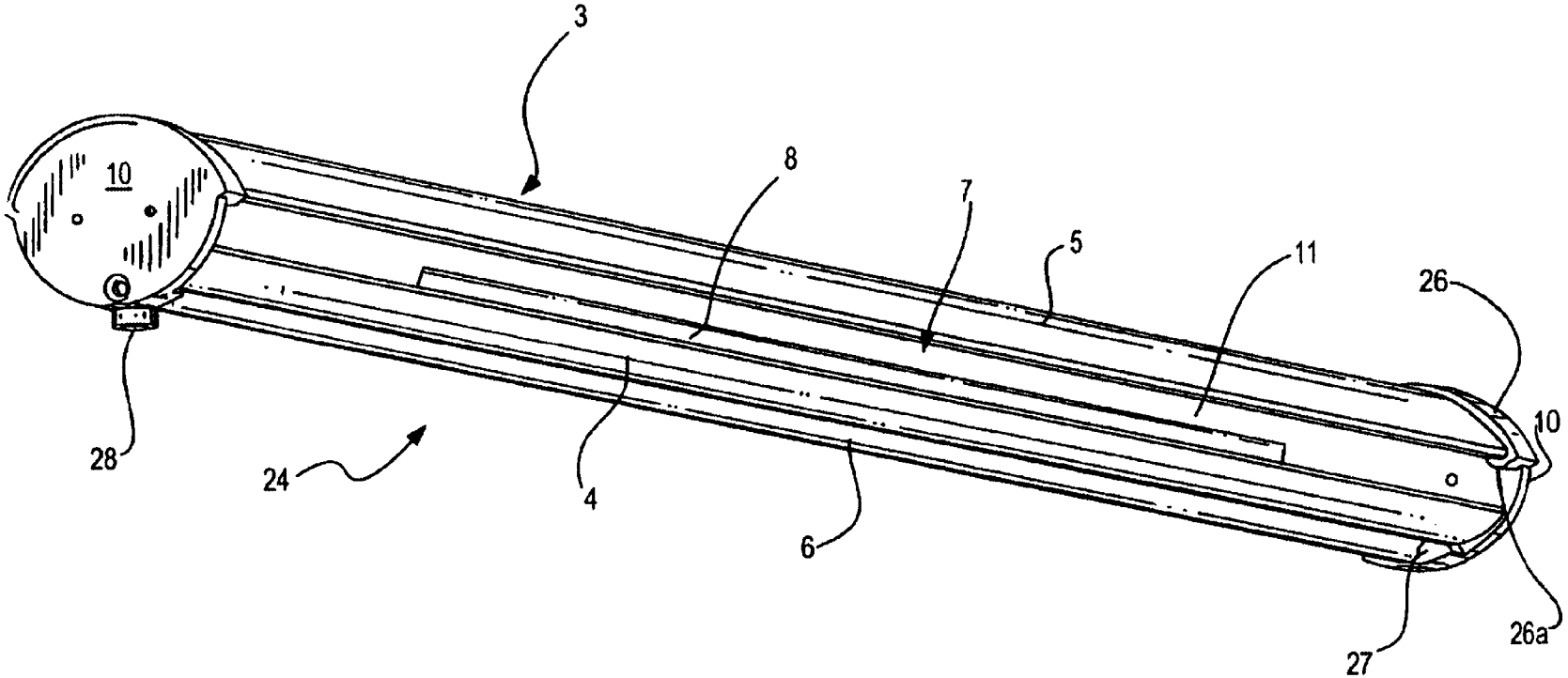
FIG. 2 is a perspective view of the first exemplary embodiment of FIG. 1 of the lamp with the reflector.
Figure 2A:
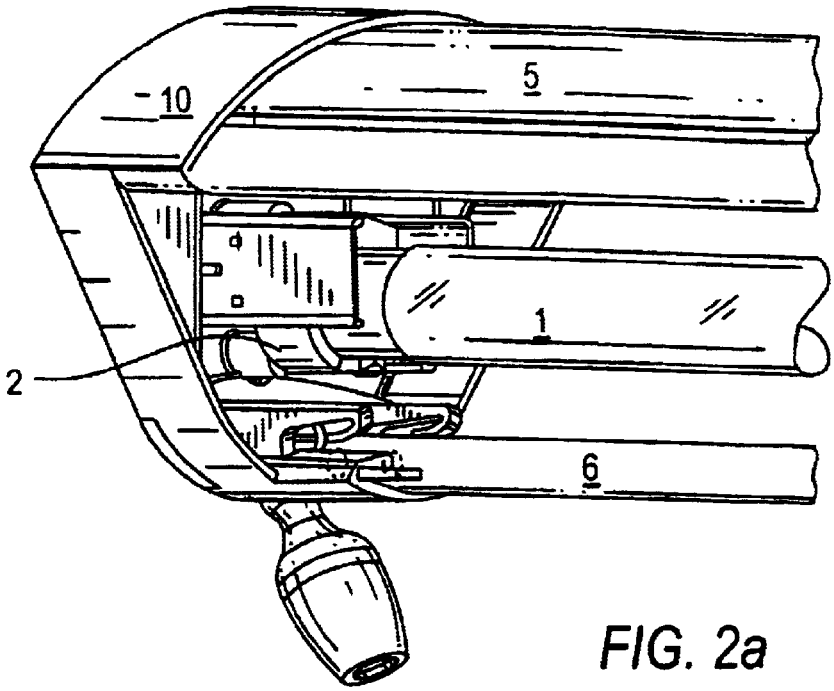
Figure 2B:
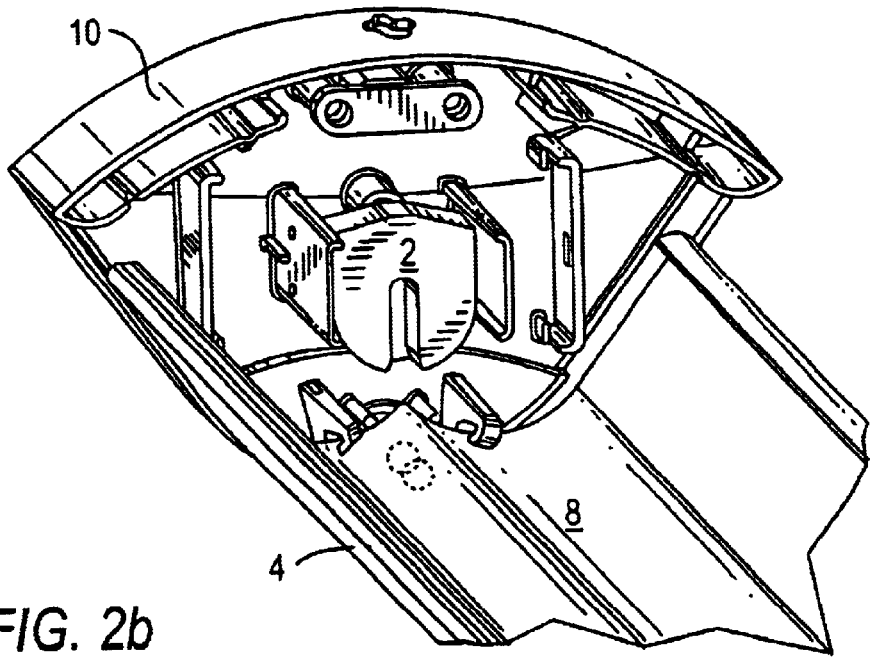
Figure 2C:
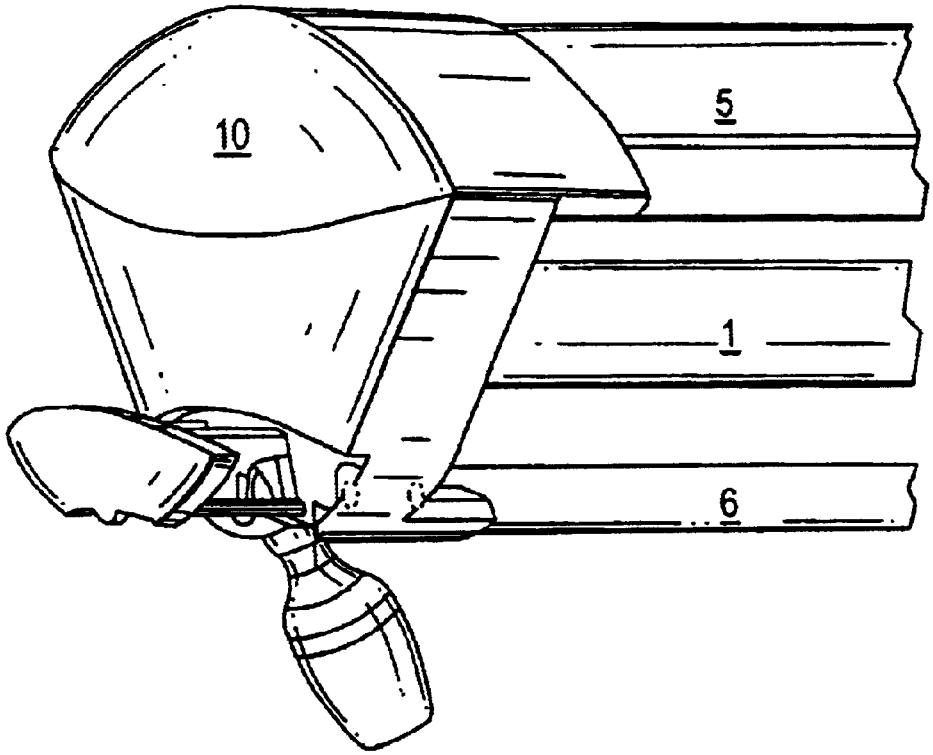
Figure 3:
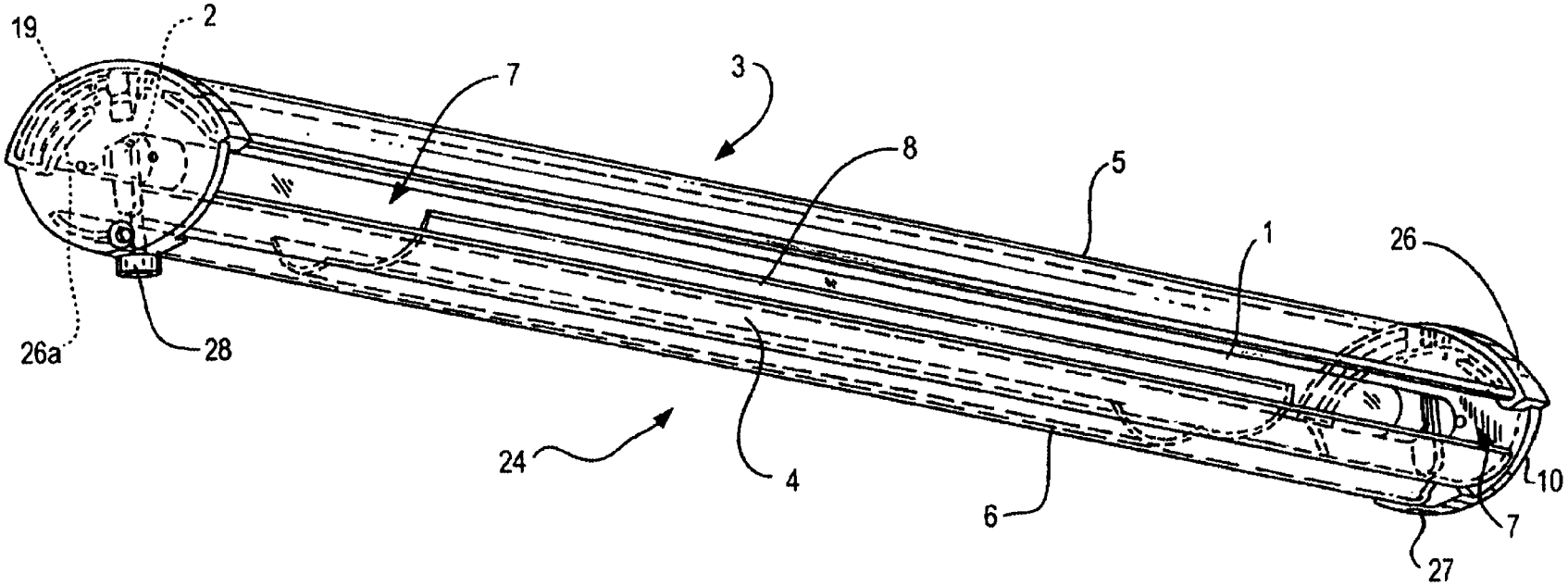

FIG. 2*a* is a partial perspective of the first exemplary embodiment of FIG. 1 of the lamp with the luminous element but without the reflector;

FIG. 2*b* is a partial perspective of the first exemplary embodiment of FIG. 1 of the lamp with the reflector but without the luminous element and the the upper housing part;

FIG. 2*c* is a partial perspective of the first exemplary embodiment of FIG. 1 of the lamp;

FIG. 3 is a view of the first exemplary embodiment of the lamp and of the reflector from the same direction as shown in FIG. 2, however, hidden edges are shown.

Figure 4:
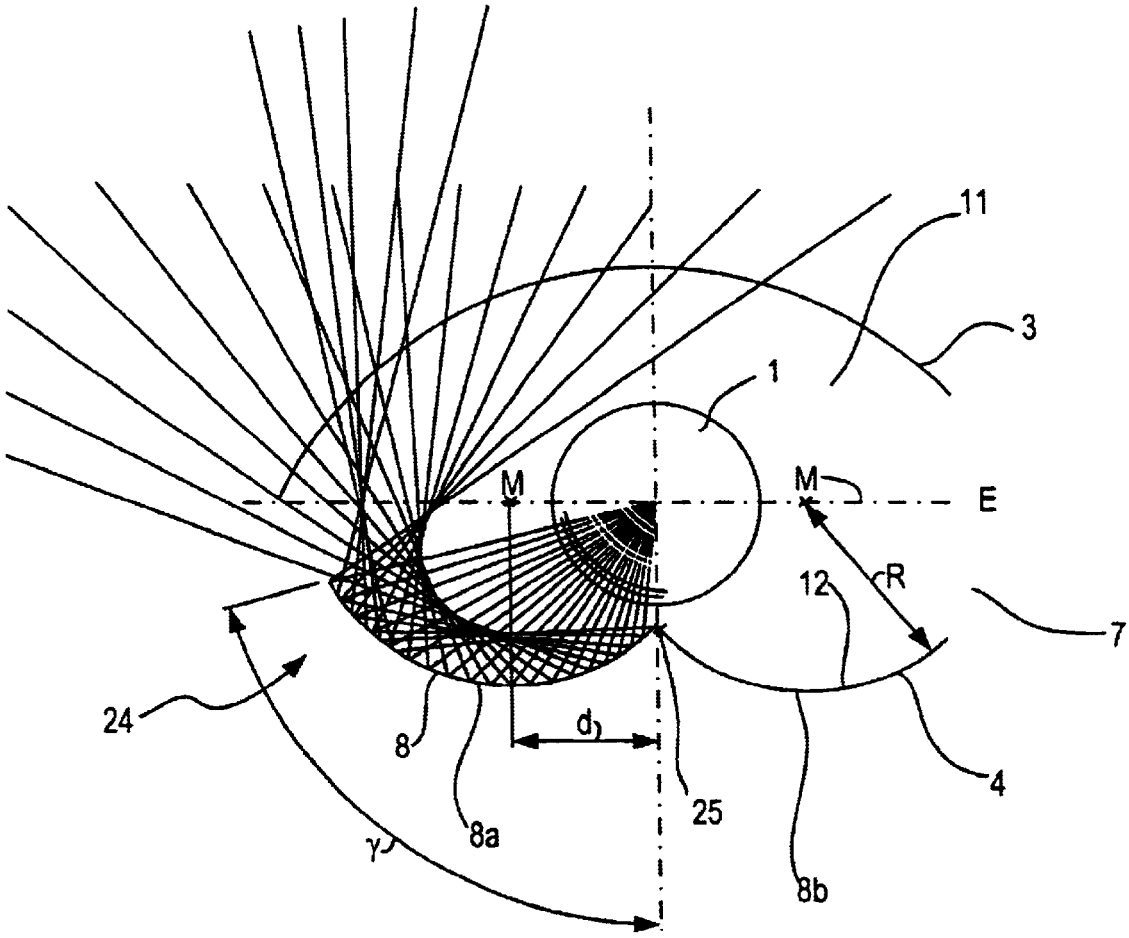
Figure 5:
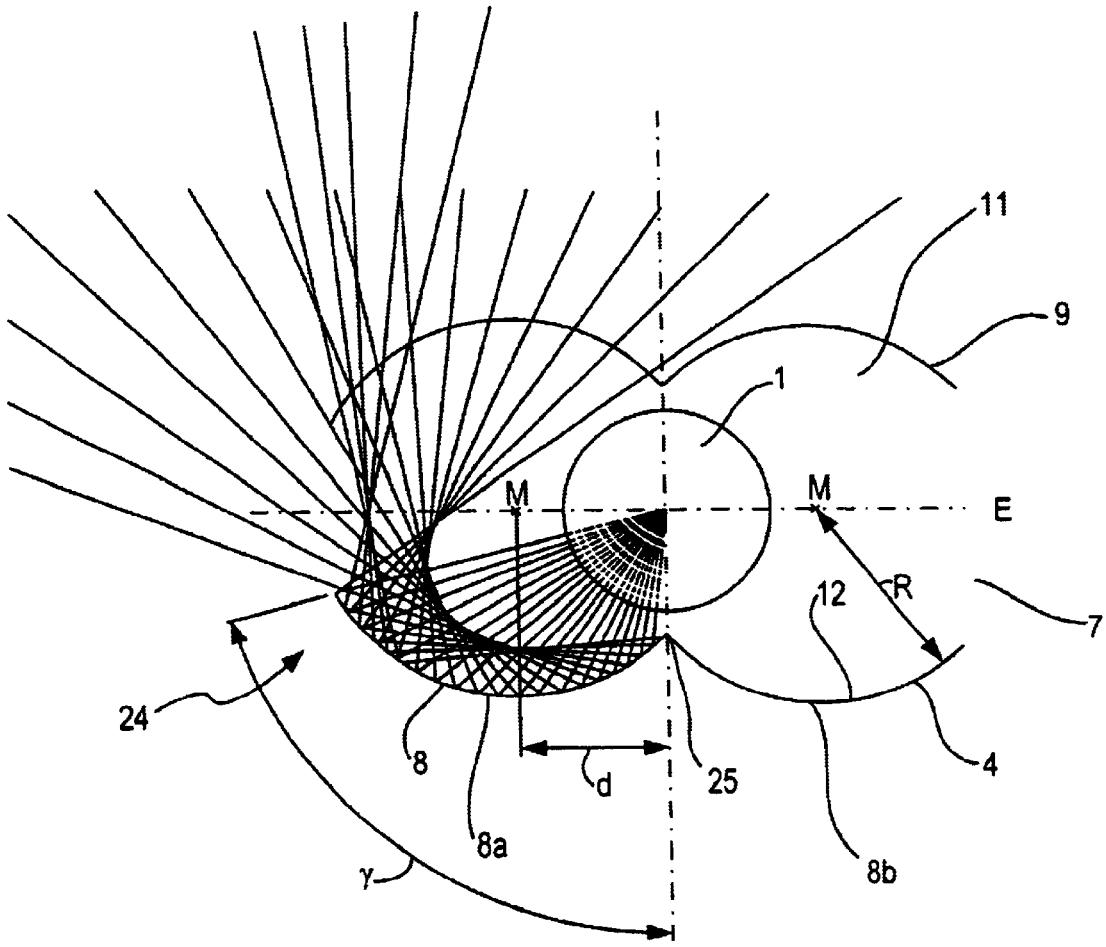
Figure 6:
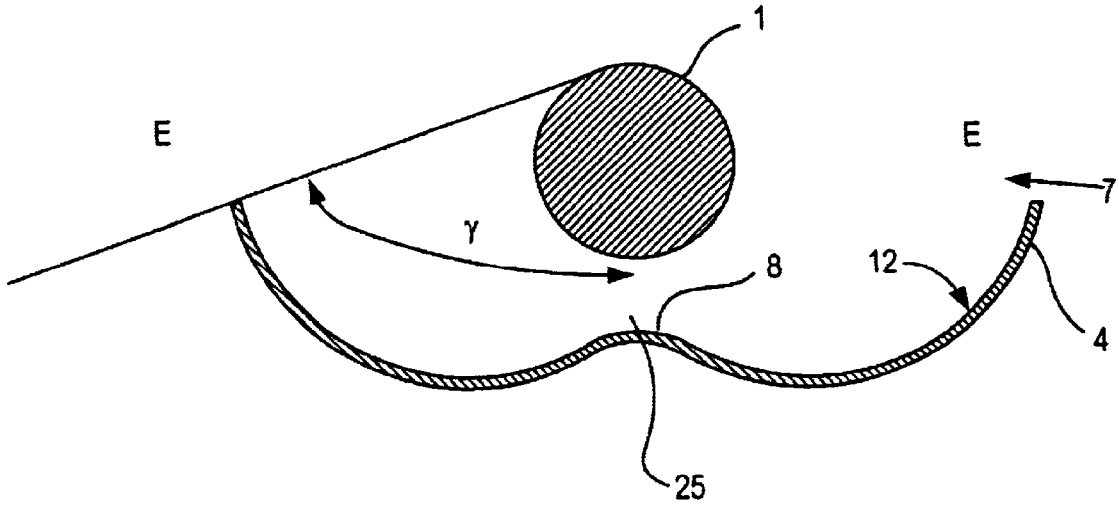
Figure 7:
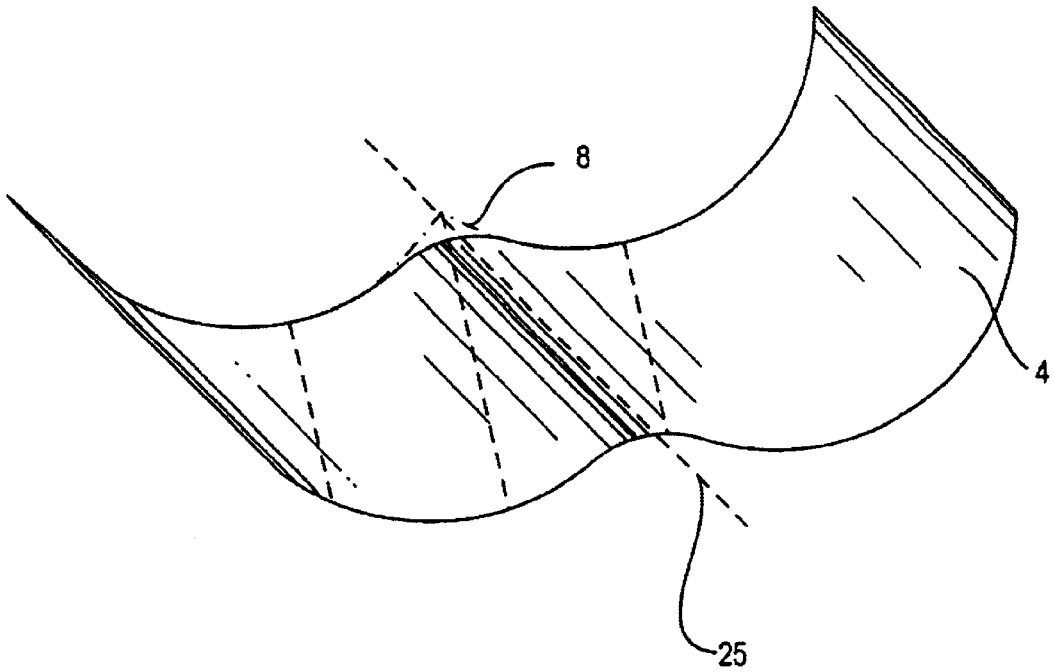
Figure 8:
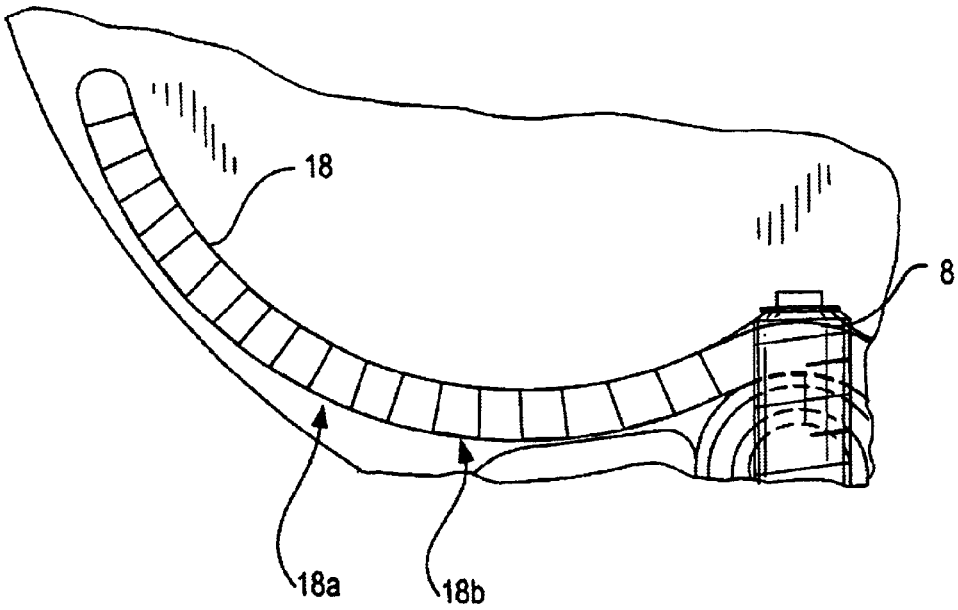
Figure 9:
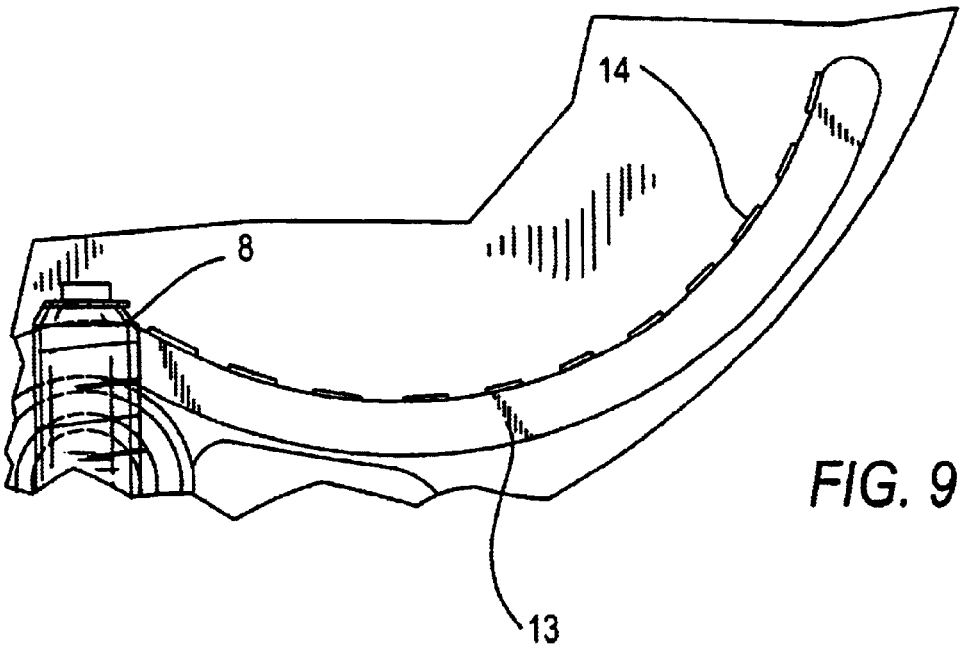
Figure 10:
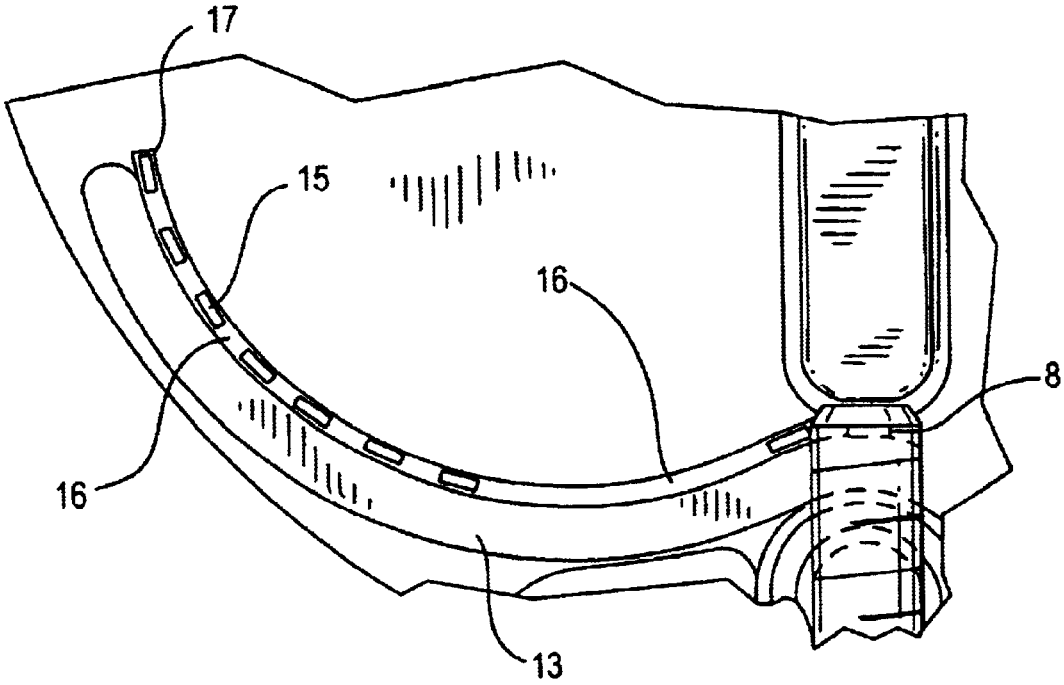
Figure 11:
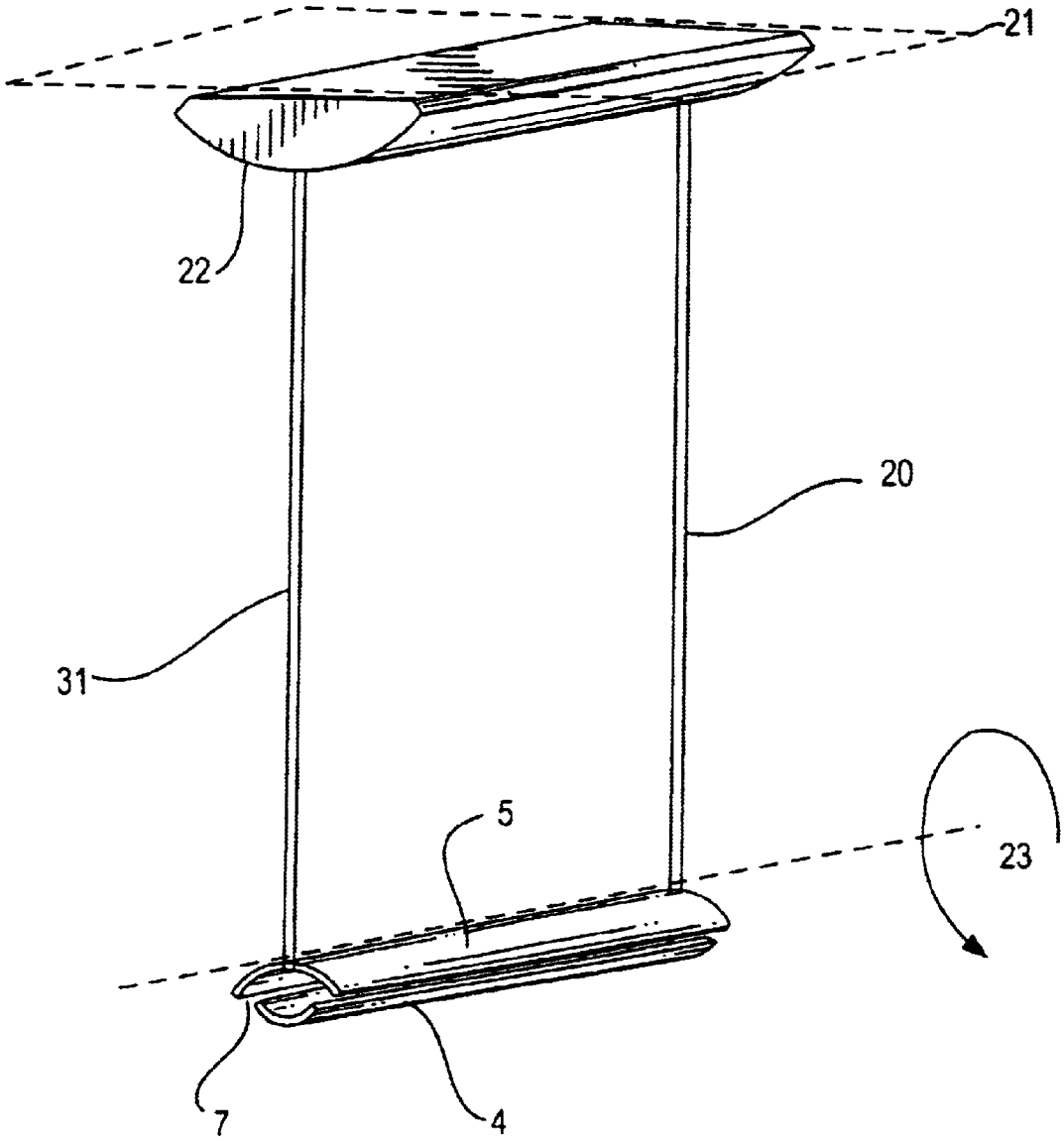

FIG. 4 shows a schematic section through the first exemplary embodiment featuring the optical path of individual light beams emitted by the luminous element;

FIG. 5 depicts a schematic section through a second exemplary embodiment of a lamp featuring a double-segmented upper housing part;

FIG. 6 represents a schematic section through a third exemplary embodiment of a reflector with a luminous element;

FIG. 7 shows of a lamp featuring only a perspective view of the third exemplary embodiment of the reflector from FIG. 6;

FIG. 8 shows a section through a part of a fourth exemplary embodiment of a reflector;

FIG. 9 shows a section through a part of a fifth exemplary embodiment of a reflector;

FIG. 10 depicts a section through a part of a sixth exemplary embodiment of a part of a reflector; and FIG. 11 is a schematic, perspective view of a fourth exemplary embodiment of a lamp in the form of a suspended lamp.

Figure 12:
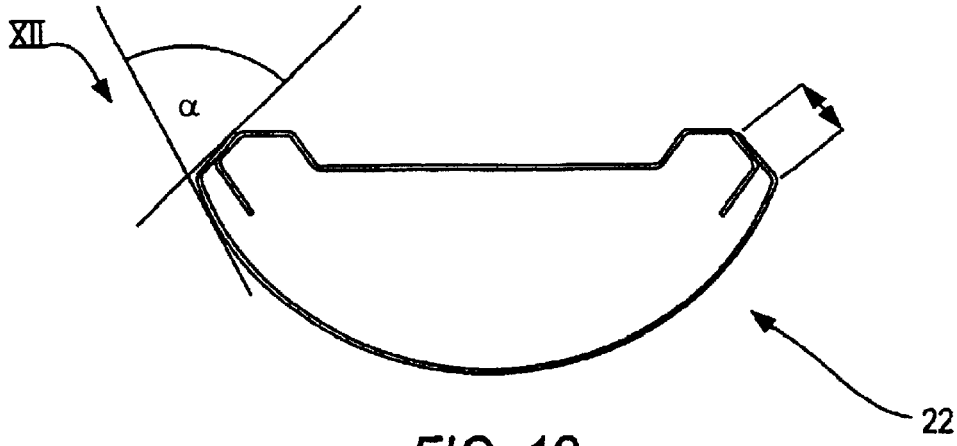

FIG. 12 is a partial cross section of the covering of the alternative embodiment of the lamp shown in FIG. 11.

Figure 13:
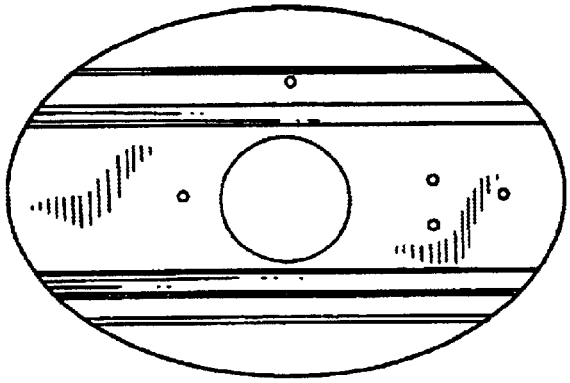

FIG. 13 is a partial plan view of an upper portion of the covering of FIG. 12.

Figure 14:
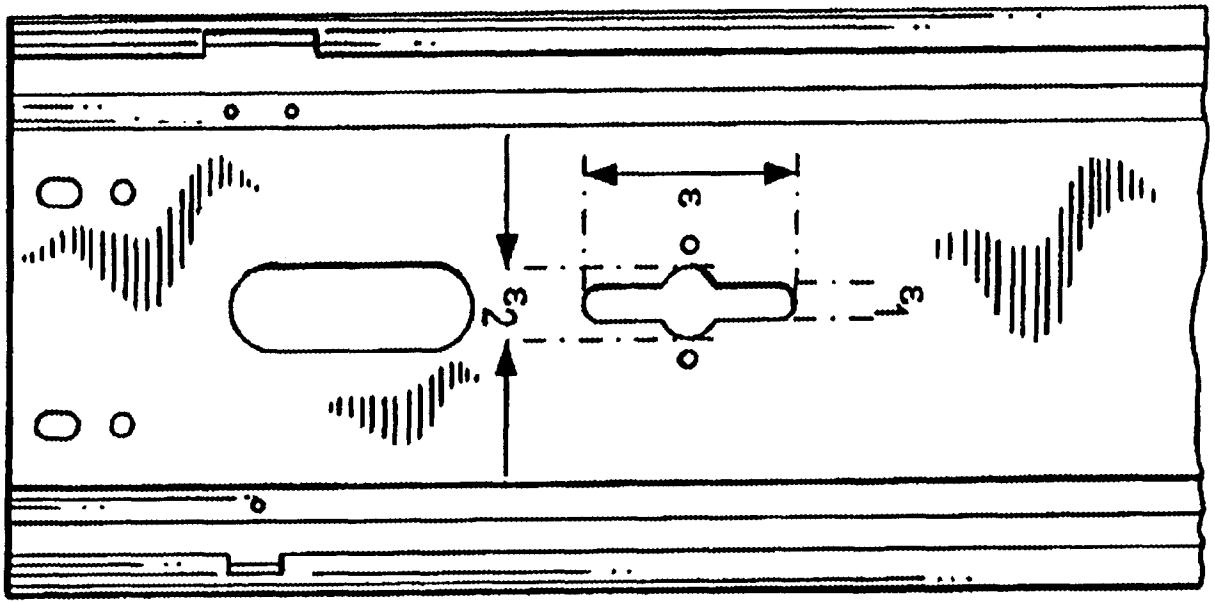

FIG. 14 is a partial plan view of an upper portion of the covering of FIG. 12.

Figure 15:
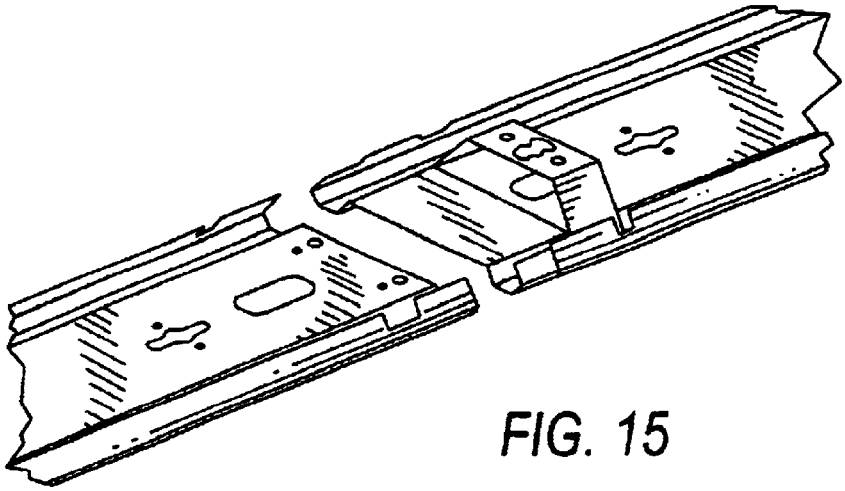

FIG. 15 is a partial perspective of an upper portion of the covering of FIG. 12.

FIG. 1 shows a section through a lamp 24. Lamp 24 has a housing 3 featuring an upper housing part 5 and a lower housing part 4. Upper housing part 5 is connected to lower housing part 4 via a connecting means 10. Upper housing part 5 is arranged on connecting means 10 in a holding device 26. Holding device 26 has two U-shaped leg members 26*a* featuring pointed noses 19 formed on the inner sides thereof. Noses 19 positively and frictionally engage with upper housing part 5, thus firmly holding it in its position relative to connecting means 10. Lower housing part 4 is waved-shaped in cross-section and has a wave crest in its middle. This wave crest constitutes an axis of symmetry 25, the lower housing part being configured symmetrically thereto. The wave crest rests on a tubular carrier body 6 which is connected to connecting means 10 via a bearing block 27 arranged on connecting means 10. Bearing block 27 encircles tubular carrier body 6 in positive locking manner over more than half its circumference. In this manner, carrier body 6 is securely fixed in position relative to connecting means 10 and, consequently, also lower housing part 4 relative to connecting means 10. A reflector 8 in the form of double-segmented reflector having two wings 8*a*, 8*b* which are arranged symmetrically to the axis of symmetry rests on lower housing part 4 in a positive-locking manner. A knurled screw 28 joins carrier body 6 to connecting means 10 and to lower housing part 4 and to reflector 8. In this manner, a simple and secure connection among these parts and to upper housing part 5 is guaranteed. Reflector 8 has a reflective surface 12 facing away from lower housing part 4. The described arrangement composed of upper housing part 5, connection means 10 and lower housing part 4 defines an interior space 11 of lamp 24. A gap 7 is formed between upper housing part 5 and lower housing part 4 and reflector 8, respectively. Arranged at connecting means 10 is a holding device 2 in the form of a lamp socket for a luminous element 1 in which a luminous element 1 is located. Holding device 2 in the form of a lamp socket supplies luminous element 1 with power.

When luminous element 1 emits light, then the air in interior space 11 of lamp 24 heats up. Gap 7 ensures air exchange with the external space so that the overtemperature in interior space 11 of lamp 24 does not rise by more than 5 degrees Celsius. The efficiency of a fluorescent tube strongly depends on the ambient temperature around luminous element 1.

Since the temperature increases only imperceptibly, the efficiency which is reduced by thermal effects drops by no more than 5% compared to a free luminous element 1, i.e. one that is not arranged inside a housing 3. Lower housing part 4 has a transparent construction whereas reflector 8 is designed such that it is partially transparent, that is, reflective surface 12 of reflector 8 lets through part of the light emitted by luminous element l; another part is reflected. The section through reflective surfaces 12 is in each case a line of second order which is made of continuously differentiable contour elements arranged side by side, in the simplest case, of circular segments or one circular segment. In this connection, the radii of curvature of the respective segments of the partially transparent reflector are identical to those of lower housing part 4, except for the material thickness. Due to the shown design of reflector 8, it is achieved that the light emitted by luminous element 1 is not reflected back onto luminous element 1 but is guided past it, thus being used for illuminating the room in which lamp 24 is located. In this manner, an optimum efficiency of lamp 24 is attained since none of the light beams which are emitted by luminous element 1 is lost. The partially transparent construction of reflector 8 permits glare suppression in the direct light. This is necessary because modern fluorescent lamps have luminances of up to 30000 cd/m$^2$. However, such high luminances are detrimental to the human eye and result in failure phenomena so that there is a necessity of glare suppression of the direct light. Therefore, the reduction in luminance via a partially transparent reflector 8 makes it possible for the user to look also into the direct light of lamp 24 of the lamp without having to expect damage to his/her health. The two gaps 7 are so large that reflector 8 can be removed from lamp 24 therethrough without difficulty. This permits easy replacement of reflector 8. This is indicated, for example, if damage has occurred to reflector 8 or if the user of lamp 24 would like use another reflector 8 featuring a different partial light transmission, a different pattern, or a different color in lamp 24. On the other hand, the gap is so small that that when the reflector (without verification of the assumption) is pushed from the right side, reflector strikes against stop nose 29 so that the gap resulting on the pushing side is smaller than a (VDE) finger so as to prevent contact with the lamp base. Alternatively, a stop ring 30 can be used in addition to stop nose 29. This stop ring prevents that the lamp base can be touched with a finger (as defined by the German Verband Deutscher Elektrotechniker) even when reflector has been removed. Optionally, a locking screw (knurled screw) 28 which is necessary (for rough operation) can be used for interconnecting lower housing part 4 and/or carrier tube 6 and partially transparent sector 8 and/or carrier tube 6 and connecting part 10. Upper housing part 5 has a completely transparent design so that the entire light which is directly emitted by luminous element 1 penetrates through upper housing part 5. The same applies to the indirect light reflected by reflector 8. Because of this, the radiant intensity of the light emitted or reflected upward is not reduced so that a uniform, pleasant illuminance is achieved over a large surface on the ceiling. The ceiling serves as a scattering body, and a good illumination of the room in which lamp 24 is located is achieved. Via noses 19 which can have a pyramidshaped or also conical design, upper housing part 5 is connected to U-shaped leg members 26*a* of holding device 26, forming a positive lock. When inserting upper housing part 5 into holding device 26, the tips of noses 19 are deformed, resulting in a wedging of noses 19 in upper housing part 5, creating a frictional and positive lock. This connection is extremely reliable, preventing unintentional detachment of upper housing part 5 from holding device 26 and thus, from connecting means 10. In the following, equally acting element are provided with identical reference symbols.

FIG. 2 depicts the first exemplary embodiment of lamp 24 known from FIG. 1 in a perspective view. Lamp 24 (without luminous element 1) is essentially cylindrical, connecting elements 10 being arranged at the end faces of lamp 24. Gap 7 extends from one end of lamp 24 to the other, i.e., from the one connecting means 10 to the other connecting means 10. Upper housing part 5 is inserted into holding device 26 of connecting means 10 and is encircled by U-shaped leg member 26*a*. Tubular carrier body 6 is supported in bearing block 27 of connecting means 10. Transparent lower housing part 4 is arranged on carrier body 6. Reflector 8, which is visible through gap 7, rests on this lower housing part 4. Reflector 8 is drawn only in a small portion of lamp 24 so that luminous element 1 arranged behind it in interior space 11 of lamp 24 is visible. In reality, reflector 8 extends over the whole length of gap 7 from one end of lamp 24 to the other.

Here, knurled screw 28 connects carrier body 6 to lower housing part 4 but not to reflector 8 so that reflector 8 can be removed from lamp 24 and replaced with another reflector 8 through gap 7.

FIG. 3 depicts the first exemplary embodiment of lamp 24 from the same perspective as in FIG. 2; however, the hidden edges are made visible here. In this manner, some details become discernible which will be discussed in the following. The features described with reference to FIG. 2*b*, will not be discussed again. Reflector 8 has two wings 8*a*, 8*b*, as is already shown in FIG. 1, and rests on lower housing part 4 essentially in a positive-locking manner. The described parts can optionally be connected to each other using a fixing device such as knurl screw 28. Luminous element 1 is supported in holding device 2 in the two connecting means 10 via which it is supplied with power. As in the preceding and in the following Figures, the electrical supply line is not shown since it is not different from conventional lamps 24 and, moreover, not essential to the present invention. It is well discernible how noses 19 at holding 26 engage with the ends of upper housing part 5 which are inserted in fixing devices 26 of connecting means 10. Also well discernible is the U-shaped encircling of leg members 26*a* around the ends of upper housing part 5. Knurled screw 28 joins the same parts as in FIG. 2.

FIG. 4 schematically shows the optical path in a lamp 24 featuring a partially transparent reflector 8 as lower housing part 4 and a transparent upper housing part 5. The light emitted upward by lighting element 1 is almost not reflected by transparent upper housing part 5. Thus, ceiling 21 generally existing above lamp 24 (see FIG. 11) is irradiated directly. The light which is emitted downward from luminous element 1 impinges on partially transparent reflector 8 so that a part of the light beams is reflected by it. Reflector 8 is geometrically configured in such a manner that the light it reflects does not impinge on luminous element 1 but is guided therearound. The light beams passing through reflector 8 are not shown for reasons of clarity. In order for reflector 8 to fulfil this specific light-guiding function, it is made of two wings 8*a*, 8*b* which are formed symmetrically to axis of symmetry 25. Here, axis of symmetry 25 runs in a direction perpendicular to the drawing plane. In cross-section, each of wings 8*a*, 8*b* of reflector 8 is formed as a curve of second order at its reflective surface 12, as a side-by-side arrangement of circular segments having a continuously differentiable curve contour, preferably as a single circular segment. In this context, the center points of the radii of curvature or the center points of the circular segments lie in median planes passing through the axis of the luminous element. In the simplest case, this is a horizontal median plane E of luminous element 1. The relation between distance d of the virtual center points and the middle of luminous element 1 to the respective radii of curvature varies in a range of from 1:1 to 2:1. Via reflector 8, the direct component of the light emitted by luminous element 1 is reduced so that the glare of the direct light is suppressed in angular range. Angle depends on how far reflector 8 is drawn upward on its contour line (circular segment line). Moreover, FIG. 4 clearly shows how gaps 7 are formed between reflector 8 and upper housing part 5, through which a good air exchange between interior space 11 of lamp 24 and the external space is possible. In this manner, it is possible to attain the high efficiency of luminous element 1 already mentioned above.

FIG. 5 shows schematic representation of a further exemplary embodiment of a lamp 24 in which, compared to the exemplary embodiment of FIG. 4, transparent upper (monosegment) housing part 5 is substituted by a double-segmented housing part 9. Along the lamp axis, the double segment is designed symmetrically to the vertical plane passing through the lamp axis of luminous element 1. Double-segmented upper housing part 9 has also a transparent construction so that a nearly identical effect ensues for the beams transmitted by it as in the case of the monosegment housing part (except for the reflection and transmission data which are changed according to the Fresnel equations); however, with a different shape and visual appearance. Equal and equally acting parts are denoted by the same reference numerals as in FIG. 4. With regard to their arrangement and mode of operation, reference is made to the description of FIG. 4. It is also possible to replace transparent upper housing part 5 by a second reflector 9. Then, second reflector 9 is constructed in the same way as first reflector 8 and arranged in mirror symmetry to first reflector 8 with respect to horizontal median plane E of luminous element 1. Second reflector 9 also has a partially transparent construction so that the same effect ensues for the beams reflected by it as that explained with respect to first reflector 8 in connection with FIG. 4. In this manner, a reduction in luminance in the direct light is attained both in the light of the luminous element emitted upward and in that emitted downward. This is particularly advantageous if lamp 24 is arranged in a room only at such a height that it can also be looked at from above. This is the case, for example, with a desk lamp 24.

FIG. 6 shows a further exemplary embodiment of a lamp 24. To simplify the representation, only luminous element 1 is depicted in its spatial relationship to reflector 8 and to lower housing part 4. The embodiment of reflector 8 is identical to that shown in FIGS. 4 and 5 so that, with regard to the individual features, reference is made to the description of these Figures. In this connection, reflector 8 rests on lower housing part 4 essentially in a positive-locking manner. Only in the region of axis of symmetry 25, lower housing part 4 is rounded and thus, remains at a distance under reflector 8. Lower housing part 4 has a transparent construction here as well whereas reflector 8 has a partially transparent surface 12 facing luminous element 1. The optical path representing the light emitted by luminous element 1 was dispensed with here but it corresponds to that depicted with regard to reflector 8 in FIGS. 4 and 5.

FIG. 7 is a perspective view of the spatial design of reflector 8 and lower housing part 4 depicted in FIG. 6. In this connection, it is well discernible that surfaces 12 of reflector 8 which, in cross-section, have the shape of circular segments, as is shows in FIG. 6, each correspond to a cylinder envelope in the three-dimensional embodiment. The two cylinder envelopes are abutted against each another along axis of symmetry 25. Using this design, the optical path shown in FIGS. 4 and 5 is obtained in the reflected light along the entire length of tubular luminous element 1 so that the reflected light is not reflected by reflector 8 into luminous element 1 but guided around it. In this manner, the high luminous efficacy described above is guaranteed along the entire length of luminous element 1.

FIG. 8 shows a further embodiment of a reflector 8. Here, a perforated plate 18 is concerned which is made of a reflective material such as aluminum and which has holes 18*a* and webs 18*b* located therebetween. Reflector 8 is partially transparent since it reflects the light beams impinging on it from a luminous element 1 only at the locations at which there are webs 18*b* between holes 18*a*. If a light beam falls on one of holes 18*a*, then this light beam passes through reflector 8 in an unhindered manner. The degree of transparency of reflector 8 and thus, of its glare suppression characteristic through the reduction of the luminance perceived by the observer is determined by the relation of the area of holes 18*a* to the area of webs 18*b* and the hole size itself. Such a reflector 8 in the form of a perforated plate 18 is very easy and inexpensive to manufacture, for example, by punching holes 18*a* out of an aluminum sheet. Thus, the buyer of a lamp 24 can chose the reflector 8 which suits him and insert it into lamp 24, depending on the use of lamp 24 and the desired properties thereof.

FIG. 9 shows a further embodiment of a reflector 8. Reflector 8 has a transparent substructure 13 made, for example, of a transparent plastic such as Plexiglas. A reflective, perforated material 14 which can be, for example, metallic, is applied to transparent substructure 13 using a screen-printing technique. This reflector 8 reflects light beams which impinge on reflective material 14. Here too, the degree of reduction in luminance attained by reflector 8 depends on the relation between the reflective area and the transmissive area and on the hole size. This means here, that the degree of reduction in luminance can be adjusted by the size of the area to which reflective material 14 is applied. A reflector 8 of that kind can be specially customized as well, and produced in many different variants with regard to the reductions in luminance.

FIG. 10 depicts another exemplary embodiment of a reflector 8. This reflector 8 has a transparent substructure 13 as well. This transparent substructure 13 has bonded thereto a film 17 which features reflective regions 15 and transparent regions 16. With regard to the degree of reduction in luminance and to the ease of manufacture or the response to customer wishes, the same applies as has already been explained above with regard to FIGS. 8 and 9.

FIG. 11 shows a further exemplary embodiment of a lamp 24. Here, a suspended lamp is concerned which is attached to a ceiling 21. Lamp 24 is shown here only schematically, upper housing part 5 and lower housing part 4 being depicted with gaps 7 situated therebetween. On the other hand, neither connecting means 10 nor luminous element 1 are shown. Lamp 24 is made so light that it is sufficient to suspend it from ceiling 21 at two sheathed electric cables 20 conducting the electric current. There is not need to use steel cables for that purpose but these could be used in additionally or incorporated into the sheathed cable. The fixing points of sheathed electric cables 20 at ceiling 21 are covered by a covering 22. Covering 22 is designed as a canopy. The covering is concave with respect to lamp 24 and extends parallel to the longitudinal extension of lamp 24. In cross-section, it has the shape of a circular segment just as the cross-section of upper housing part 5. Thus, a design in the form of a cylinder envelope segment ensues for covering 22. Apart from the aesthetic effect that the fixing points of lamp 24 at ceiling 21 are covered, such a covering 22 has also a positive effect on the illumination of the whole room in which lamp 24 is located. Due to the concave design with respect to lamp 24, no punctiform high luminances, so-called "luminance peaks" occur but a homogenous luminance distribution ensues. Thus, the light beams in the light emitted or reflected upward which are scattered at covering 22 bring about a uniform indirect illumination of the room which is pleasant for the observer. The two points at which the two sheathed cables 20 exit lamp 24 define an axis 23 running parallel to the two gaps 7. This axis 23 running at the upper side of upper housing part 5 serves as a swivel axis about which the whole lamp 24 can swivel. By turning lamp 24 about this axis 23, it possible to swing lamp 24 into a position in which one of the two gaps 7 forms the lowest point of lamp 24. Because of this, foreign bodies which possibly have accumulated in interior space 11 of lamp 24 fall out of lamp 24. Thus, an easy and inexpensive way is provided for cleaning interior space 11 of lamp 24. This is necessary, for example, when flies have flown into interior space 11 of lamp 24 and, there, are no longer able to fly due to the high thermal stress. This is particularly advantageous if lamp 24 is designed in two pieces since a lamp 24 having a one-part design cannot be taken apart into upper housing part 5, lower housing part 4 and connecting means 10.

What is claimed is:

1. A lamp (24) comprising a holding device (2) for a luminous element (1) and a housing (3) which, at least partially, surrounds an interior space (11) provided for the luminous element (1), the housing (3) featuring an upper housing part (5) and a lower housing part (4), wherein a least one gap (7) exists between the upper housing part (5) and a lower housing part (4) through which air exchange is possible between the interior space (11) of the lamp (24) surrounded by the housing (3) and the external space, and further wherein the upper housing part (5) features a fist reflector (9) and the lower housing part (4) having a second reflector (8) which are each partially transparent.

2. The lamp (24) as recited in claim 1, wherein the upper housing part (5) and/or the lower housing part (4) are/is connected to connecting means (10) in an easily detachable manner.

3. The lamp (24) as recited in claim 2, wherein the connecting means (10) have noses (19) which frictionally and positively engage with the upper housing part (5) and with at least one of the lower housing part (4).

4. The lamp (24) as recited in claim 2, wherein the lower housing part (4) has a two-part design, featuring a carrier body (6) to which the reflector (8) is detachably connected and which is held in its position relative to the upper housing part (5) by the connecting means (10).

5. The lamp (24) as recited in claim 4, wherein the lower housing part (4) and/or the reflector (8) are/is connected to the carrier body (6) and the connecting means (10) via a simple knurled screw (28).

6. The lamp (24) as recited in claim 4, wherein the at least one gap (7) runs (horizontally) parallel to the carrier body.

7. The lamp (24) as recited in claim 1, wherein the at least one gap (7) is sized such that at least one of the reflectors (8, 9) fits through it.

8. The tamp (24) as recited in claim 1, wherein two gaps exist which are parallel to each other.

9. The lamp (24) as recited in claim 1, wherein the upper housing part (5) has a convex design with respect to the interior space (11) of the housing (3).

10. The lamp (24) as recited in claim 1, wherein the upper housing part (5) is transparent.

11. The lamp (24) as recited in claim 1, wherein the lamp is able to swivel about an axis (23) parallel to the at least one gap (7).

* * * * *